US006681530B1

(12) United States Patent
Givens

(10) Patent No.: US 6,681,530 B1
(45) Date of Patent: Jan. 27, 2004

(54) ONE-PIECE FLASHING

(76) Inventor: Robert D. Givens, 3311 Arthur Walker Rd., Maryville, TN (US) 37803

( * ) Notice: Subject to any disclaimer, the term of this patent is extended or adjusted under 35 U.S.C. 154(b) by 0 days.

(21) Appl. No.: 09/451,540

(22) Filed: Dec. 1, 1999

(51) Int. Cl.[7] ..... E04D 1/36
(52) U.S. Cl. ..... 52/58; 52/408; 52/62; 108/16
(58) Field of Search ..... 52/97, 62, 58, 52/11

(56) References Cited

U.S. PATENT DOCUMENTS 2,851,973 A * 9/1958 Stark et al. ..... 108/16
5,077,943 A * 1/1992 McGady ..... 52/58
5,581,959 A * 12/1996 Occhipinti ..... 52/58
5,815,986 A * 10/1998 Laska ..... 52/62
6,122,874 A * 9/2000 Smerilli ..... 52/408

FOREIGN PATENT DOCUMENTS

GB 277169 * 9/2000

* cited by examiner

*Primary Examiner*—Beth A. Stephan
*Assistant Examiner*—Steve Varner

(57) ABSTRACT

A one-piece, watertight flashing having first, second, and third panels joined together by first, second, and third elongated, watertight regions of intersection. The elongated regions of intersection intersect at a watertight common corner. The first and second panels are at a first angle with respect to each other in the first region of intersection, the second and third panels are at a second angle with respect to each other in the second region of intersection, and the first and third panels are at a third angle with respect to each other in the third region of intersection. At least one of the angles is a non-right angle.

21 Claims, 8 Drawing Sheets

ONE-PIECE FLASHING

BACKGROUND OF THE INVENTION

1. Field of the Invention

This invention relates to one-piece flashings pre-formed to fit against building surfaces at certain multi-surface intersections, especially at a common corner where several of the surfaces meet and where the possibility of water infiltration has heretofore been particularly likely to occur.

2. The Prior Art

Standard practice to prevent water infiltration at an intersection of several surfaces on structures, such as houses and other buildings, has been to create rigid, multi-piece flashings on the job by bending pieces of sheet metal during the construction or repair of such structures. The assembled flashings are then fitted against the intersecting building surfaces with at least part of at least one of the sheet metal pieces overlapping part of another. The joints between overlapping pieces are sealed by caulking material or the like. Although construction of these multi-piece flashings is time-consuming and difficult to do, they have been found to be unavoidable where the intersection to be sealed requires the flashing to have more than two panels.

Not only is a three-panel flashing inherently difficult to form on the job, especially where the arrangement of the panels is such that the flashing cannot be cut as a unitary structure from one piece of sheet metal, but the intersection to be protected requires that at least one of the three panels intersect at least one of the other panels at an angle other than a right angle. This is due to the fact that at least one of the panels is in a plane parallel to a roof surface, and at least one other panel is parallel to a surface that intersects the roof surface at the non-right angle. In addition, the non-right angle may have a variety of values according to the design of the building, since it is common for roofs on different buildings, and even on the same building, to have different slopes. This further increases the difficulty of forming the flashing of multiple pieces in advance of construction of the building and taking it to the job site ready to install.

Another serious problem in multi-piece flashings is that, over a period of time, the caulking tends to break down and lose its adhesion to the surface with which it is supposed to bond. This breakdown can occur at any time, and it is not uncommon for it to occur within four or five years, or sometimes less, from the date the caulking was applied. If that happens and a substantial amount of moisture works its way into the building as a result, the damage to the building can be substantial. Water is particularly likely to infiltrate the building at a common corner where three building surfaces intersect.

One way that the building trades responsible for initial construction or repair of the parts of a building where such infiltration is likely to occur have tried to prevent it is by applying a lot of caulking material as a coating on potential trouble spots. Even if that works as a technique for long-time prevention of water infiltration, the area thus coated is likely to display an unsightly agglomeration of caulking material.

OBJECTS AND SUMMARY OF THE INVENTION

It is an object of this invention to provide one-piece, pre-formed flashings, each having a shape that fits certain surface intersections on a building.

It is another object to provide one-piece flashings shaped to fit standard surface intersection angles on a building to achieve economy of scale by manufacturing such flashings in quantity.

A further object is to provide one-piece flashings comprising at least three intersecting panels to fit a building at the intersection of three building surfaces.

Another object is to provide one-piece flashings formed to fit the intersection of vertical building walls with roofs intersecting those walls at certain standard slopes.

Yet another object of this invention is to provide a one-piece flashing comprising a plurality of panels of material impervious to water, each of the panels having first and second edges that radiate from a common location, the first and second edges of each of the panels being joined watertight respectively to the first edge of the panel on one side thereof and to the second edge of the panel on the other side thereof, the common locations of all of the panels being substantially at a watertight corner, and the panels being angularly displaced from each other with at least one of the panels being displaced from at least one other of the panels by an angle other then 90°.

Still another object is to provide a self-supporting, one-piece flashing to be fitted against at least two flat, intersecting, non-coplanar surfaces of a building to prevent infiltration of water into the building, said flashing comprising: first, second, and third panels of water-tight, weather-resistant material, each panel comprising first and second edges that converge toward a common location and a third edge that forms a respective part of the periphery of the flashing, each of said first and second edges of each panel radiating out from the common location to the respective part of the periphery of the flashing and being joined watertight to respective proximal second and first edges of each of the adjoining panels on both sides thereof with the common location of each panel being closely adjacent to and joined watertight to the common location of each of the other panels to form a watertight common corner, at least two of the panels being substantially flat, and at least one of the panels intersecting another of the panels at an angle other than perpendicular, the flashing being watertight from the watertight common corner outward along each of said panels and each of said edges thereof.

Another object is to provide a pre-formed flashing for preventing water infiltration at the intersection of surfaces of a building, said flashing comprising: a first water-impervious panel that has first and second edges that converge toward a first common location; a second water-impervious panel that has first and second edges that converge toward a second common location; a first water-impervious region of intersection joining the first edge of the first panel to the first edge of the second panel, the second panel being angularly displaced at a first angle with respect to the first panel; a third water-impervious panel having first and second edges; a second water-impervious region of intersection joining the first edge of the third panel to the second edge of the second panel; a third water-impervious region of intersection joining the second edge of the third panel to the second edge of the first panel; at least a portion of the third panel being angularly displaced at a second angle with respect to the first panel and at least a portion of the third panel being angularly displaced at the second angle with respect to the second panel, whereby the first, second and third panels and the water-impervious regions joining those panels together define a common corner impervious to water.

Yet a further object is to provide a method of producing a self-supporting, multi-panel, water-impervious flashing comprising the steps of: heating a quantity of plastic at least sufficient to constitute the flashing; and forming the heated plastic into a desired shape that includes at least three panels, each not substantially thicker than ⅛" and oriented with respect to each other such that they intersect at a common watertight corner.

Those who are skilled in the technology with which this invention deals will recognize further objects after studying the following description.

This invention comprises a one-piece flashing formed with first and second panels joined together, watertight, at a first angle along a first line of intersection. The first angle may be a right angle or it may be the angle between a sloping roof and a vertical wall. The flashing further includes a third panel that makes a watertight junction with the first panel along a second line of intersection, where the first and third panels meet at a second angle. The third panel also makes a watertight junction with the second panel along a third line of intersection and at a third angle, and the three lines of intersection meet at a common point. It is essential that the panels and all of the junctions between the panels along all of the lines of intersection, and especially at the common point, be impervious to water. This can be accomplished by forming the flashing as a unitary structure, such as by stamping it or molding it, and, if necessary, forming permanent seals at any abutting edges created during the formation of the flashing.

The angles formed at the intersections of the three panels are determined by the angles at intersections between surfaces of the structure against which the flashing must fit. One of the panels typically is in virtual surface-to-surface contact with a portion of the roof of the building and another of the panels is in virtual surface-to-surface contact with a vertical wall intersected by the roof. The third panel can be in virtual surface-to-surface with another wall, or it can be free-standing, but still making angles with the other panels, and, together, these panels and the water-impervious regions of intersection that join them together prevent water from infiltrating at the common point where the panels meet.

The invention will be described in greater detail in connection with the following drawings.

DETAILED DESCRIPTION OF PREFERRED EMBODIMENTS

Figure 1:
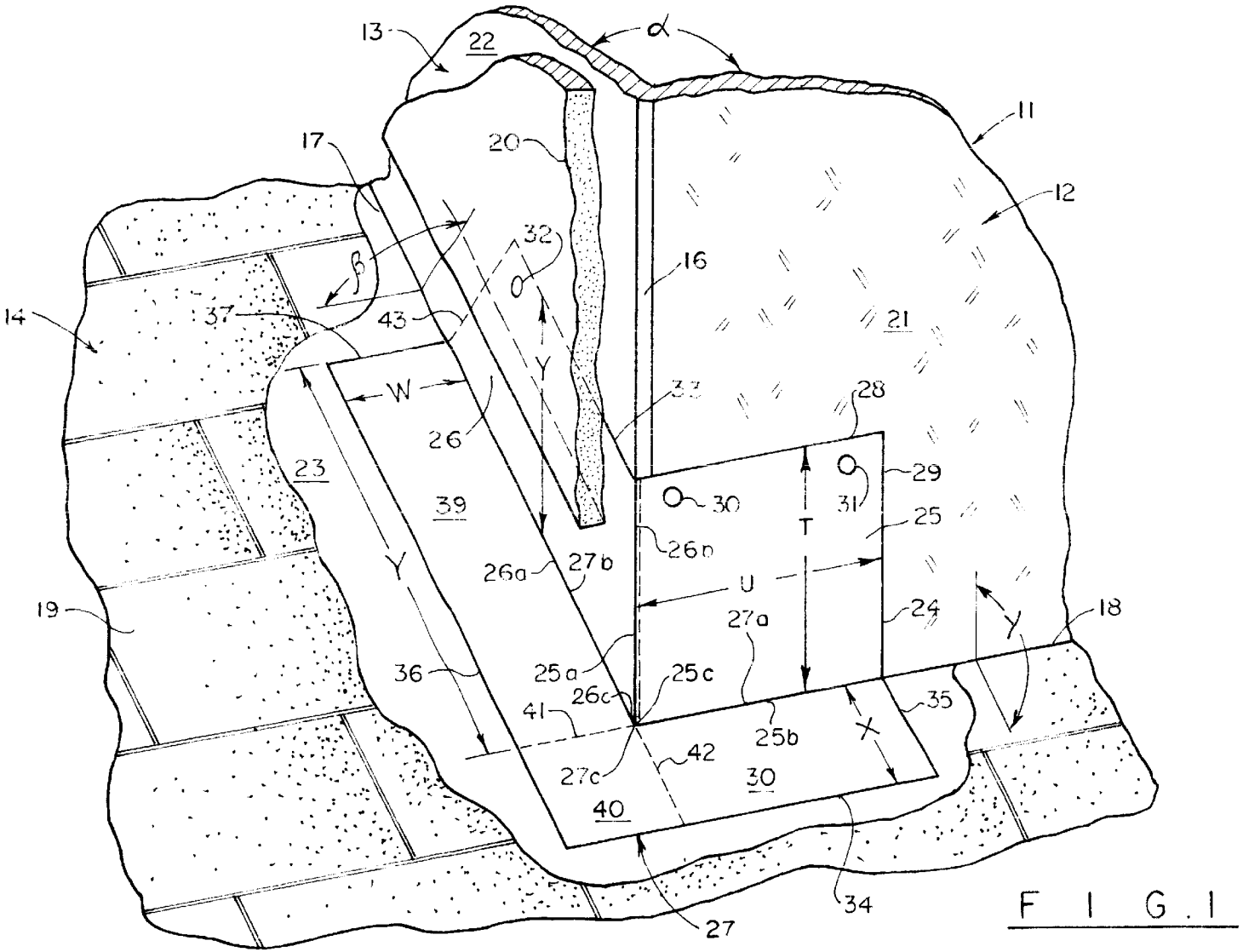
FIG. 1 is a perspective view of one example of a corner or chimney flashing positioned against a fragment of a building including a sloping roof surface and two vertical surfaces, such as vertical wall surfaces of a dormer or a chimney.

FIG. 1 shows a fragment of a dormer 11, including fragments of its front and side surfaces 12 and 13, extending above a fragment of a shingled roof 14. The front surface of the dormer intersects the side surface perpendicularly along a line of intersection 16. The side surface 13 or the dormer intersects the roof perpendicularly along a line of intersection 17. The roof 14 intersects the front surface 12 along a line of intersection 18 at an angle $\gamma$ that is not 90° and is measured in an imaginary plane perpendicular to the line 18.

The roofing material used in this embodiment includes shingles 19 along with other materials that are well-known as being used in roofing systems. These other materials, such as roofing felt, do not significantly affect the angular dimensions involved in the following description and will not be discussed. For illustrative purposes, a fragment of exterior cladding material 20 is shown attached to the side 13 of the dormer. In this instance, the material 20 is exterior insulating and finish system, commonly referred to by its acronym EIFS, but other cladding materials may be used instead. Other materials commonly placed between the outer materials, i.e., the shingles 19 and the cladding 20, and the underlying structures to which they are attached are not shown, although they are understood to be present in accordance with good building practices.

The exterior siding components that would normally be applied to the front surface 12 of the dormer have been removed to expose the front sheathing 21, and the fragment of cladding 20 is shown as only covering part of the sheathing 22 on the side 13. Part of the shingles, along with other components of the roof system that would normally be underneath them, have been stripped away in the area immediately adjacent the dormer 11 to display the roof sheathing 23 underneath. The sheathings provide a physically supporting base for other components, such as the roofing material and the cladding. Not shown in the drawing but typically used in actual construction is a thin layer of wrapping material applied directly over the wall sheathings as a weather barrier, and The one-piece flashing 24 is attached on top of that weather barrier. Tyvek is a wrapping material frequently used for that purpose, as is 15 lb. felt.

One embodiment of a one-piece flashing 24 formed with a plurality of panels according to this invention is shown in the stripped regions of the roof 14 and the dormer 11 in virtual surface-to-surface contact with the sheathings 21–23. The thin, standard layers of weather barrier are not shown. In this embodiment the flashing has three such panels 25–27, each of which comprises a first edge 25*a*–27*a* that meets a second edge 25*b*–27*b* of the same panel at a corner 25*c*–27*c*, respectively. Each of the edges 25*a*–27*a* is joined watertight with the edge 25*b*–27*b* of another one of the panels along the entire line, or region, of intersection between those panels, and the corners 25*c*–27*c* of all of the panels meet and form a watertight common corner location. The watertightness of the intersections of these panels and of their common corner is essential to successful operation of the one-piece flashing 24 in preventing infiltration of water into the lines of intersection 16–18 of the underlying sheathing materials 21–23.

Since the panels 25–27 are in virtual surface-to-surface contact with the sheathings 20–22 (ignoring any thin layer of Tyvek or other material of negligible thickness), the panels intersect each other at the same angles as the sheathings. The angles between the front and side walls and between the side wall and the roof are each 90°, which is the common angle of intersection between the front and side of most dormers and between the side of most dormers and the roof. Although only one side of a dormer is shown, it is well known that dormers normally have two sides, and a mirror image of the flashing 24 will normally be required.

The angle γ is not 90°. As can be seen, it is greater than 90° since it is the angle between the vertical sheathing 21 and the sloping roof sheathing 23 and is therefore equal to 90° plus the slope angle. Different roofs have different slopes, and so the angle γ has to be based on the architectural design of the building on which the one-piece flashing of this invention is to be used. The slope is the ratio obtained by dividing the vertical rise from a given point on the roof to a higher point on the roof by the distance along a horizontal line, one end of which is at the given point and the other end is directly under the higher point. The standard horizontal distance used in such computations is 12", and the slope is therefore specified in inches of rise divided by 12". A typical standard slope is a 4" rise for 12" along the horizontal line and is spoken of as 4/12. Other standard slopes are 5/12, 6/12, 8/12, 10/12, and 12/12, which correspond to slope angles of approximately 18°30', 22°40', 26°40', 33°40', 39°50', and 45°, respectively. The angle γ is 90° greater than these angles. While this angle could be based on other than the standard slopes, it is preferable, to obtain economies of scale in the commercial manufacture of the one-piece flashing, manufacture the flashings to fit building surface intersections that incorporate standard slopes.

FIG. 1 illustrates the flashing 24 as being used on the corner of a dormer, but it can also be used on other corners of corresponding configuration, such as the lower corner of a chimney and a sloping roof, for example, and will be referred to hereinafter as a corner flashing.

In this embodiment, the angle between the first panel 25, which is pressed against the front sheathing 21, and the second panel 26, which is in virtual surface-to-surface contact with the side sheathing 22, is the same 90° angle as those sheathings, and the angle between the second and third panels 26 and 27 is the same 90° angle as the angle between the side sheathing 22 and the roof sheathing 23, since the latter panels are in virtual surface-to-surface contact with the side sheathing 22 and the roof sheathing 23, respectively. Similarly, the angle between the panels 25 and 27 is the same as the angle γ between the front sheathing 21 and the roof sheathing 23.

The first panel 25 in this embodiment is rectangular, with a vertical height T measured from its lower edge 25*b* to its upper edge 28 and a horizontal width U measured from the left-hand edge 25*a* to the right-hand edge 29. The height T and width U are great enough so that most of this panel will be well covered by material to be applied later to the front sheathing 21. A suitable value for T is 8" and for U is also 8", although the invention is not limited to these values. Furthermore, the upper part of the edge 28 need not be horizontal and the side part of the edge 28 need not be vertical, as shown and neither part need be straight, as long as both parts of the edge 28 are well covered by the wall cladding to be applied later in the construction of the building.

The panel 25 may be provided with one or more fastener holes 30 and 31 close enough to the upper edge 28 and to its left edge 25*a* and right edge 29 (preferably within about an inch in each instance) so that the fasteners (typically nails) to be driven through these holes will hold the one-piece flashing 24 firmly in place against the front sheathing 21 of the dormer 11 and will also be well protected by cladding later to be applied to the front sheathing 21.

The panels 25–27 may not be absolutely flat as manufactured; they may be somewhat warped, particularly according to the type of manufacturing used. However, they are sufficiently flat to justify the use of that term, and fastening them in place on the building surfaces improves their flatness under the circumstances that count. The second panel 26 is held flat against the side sheathing 22 by a fastener through a hole 32 in its upper rear corner and by the fasteners through the holes in the panel 25. These three fasteners are sufficient, with the assistance of the cladding and roofing materials later to be applied overlapping the panels 25–27, to hold the one-piece flashing 24 firmly in place. The nail holes 30–32 are sufficiently protected from water infiltration so that they do not keep the panels from being watertight, or impervious to water, as the panels are used.

The dimension V of the panel 26 in the vertical direction, i.e., parallel to the vertical edge 26*b*, is such that the upper edge 33 in this embodiment intersects the upper edge 28 of the first panel 25 at the line of intersection of the edges 25*a* and 26*b*. Although this is less than the height T of the panel 25, it is makes the width of the panel 26, as measured in the direction perpendicular to the edge 26*a* sufficient to cause the upper edge 33 to extend well above the lower edge of any cladding, such as the cladding 20 applied to the side surface 13 of the dormer 11. The perpendicular distance from the edge 26*a* to the edge 33 is preferably at least about 6".

The roof panel 27 is L-shaped and is entirely watertight from the watertight intersection of the edge 27*a* with the edge 25*b* to its lowermost edge 34 and from its edge 35 farthest to the right to its edge 36 farthest to the left and from its uppermost edge 37 to the edge 34 and from its edge 36 to the watertight intersection of the edge 27*b* with the edge 26*a* of the panel 26. The fact that the panel 27 is L-shaped and yet lies entirely flat against the roof sheathing 23 makes it convenient to think of the panel 27 as comprising three areas 38–40. The area 38 is partly bounded by the edges 27*a*, 35, and part of edge 34, and the area 39 is partly bounded by the edge 37, the edge 27*b*, and part of the edge 36. The lower, left corner area 40 of the panel 27 could be considered to be part of either the area 38 or the area 39 and is partly bounded by the remainder of the edge 34 and the remainder of the edge 36.

One way of creating the one-piece flashing out of sheet metal is to form the panel 25 and the area 38 from a first piece of the metal and the panel 26 and the area 39 from a second piece of metal. The corner are 40 could be an integral part of either the area 38 or the area 39, and the two pieces could be joined together watertight along the intersections of the edges 25*a* and 26*b* and along a line of intersection 41 or 42, depending on whether the area 40 was part of the area 38 or 39.

Alternatively, the whole one-piece flashing can be pressed, or shaped, of a single piece of metal as a single, watertight unit. It can also be assembled of plastic sheets joined together at their edges into a watertight whole. And it can be molded as a single unit of plastic, such as by injection molding or pressure molding or vacuum forming. However, the panels should not be so thick as to lift the edges of the shingles or other roofing material, or the wall cladding, away from the surfaces they are supposed to be against. To do so would allow wind to get under the lifted edges and would facilitate infiltration of water. Metal of about 32 gauge or plastic having a thickness of not more than about 0.0625" is preferred. Aluminum can be used, although it is somewhat difficult to weld in that it requires a high current. However, it may require a surface coating to prevent corrosion. Plastic capable of withstanding the environmental conditions to which it is likely to be exposed, and which has the necessary strength, can be used. Vinyl of the type used on exterior wall surfaces of houses is a good choice.

If the one-piece flashing 24 is formed of sheet metal, it would also be possible to fold the panels 25 and 26 and both areas 38 and 39 out of one piece of sheet metal to which the corner area 40 would then be joined by watertight seals, for example, welds, 41 and 42.

The flashing 24 could be formed in still other ways, but it is essential that it be a one-piece, watertight unit shaped to fit the building surfaces as delivered to the job site.

The dimensions of the areas 38–40 of the panel 27 are such as to place the edges 34 and 36 well under the shingles 19 that, in the completed roof, will overlap them. For example, the perpendicular distance W from the edge 27*b* to the edge 36 may be 4" or more, and the perpendicular distance X from the edge 27*a* to the edge 34 may also be 4". The length Y of the area 39 alongside the side wall is 14". It is not essential that the edges 28, 29, 33–37, or the rear edge 43 of the panel 26 be absolutely straight or parallel to other edges provided that all of the panels of which they form boundaries extend far enough under any cladding or roofing materials later to be applied to prevent water from infiltrating around these edges. While the dimensions indicated herein are suitable for use in buildings, they should not be construed as limiting this invention.

Figure 2:
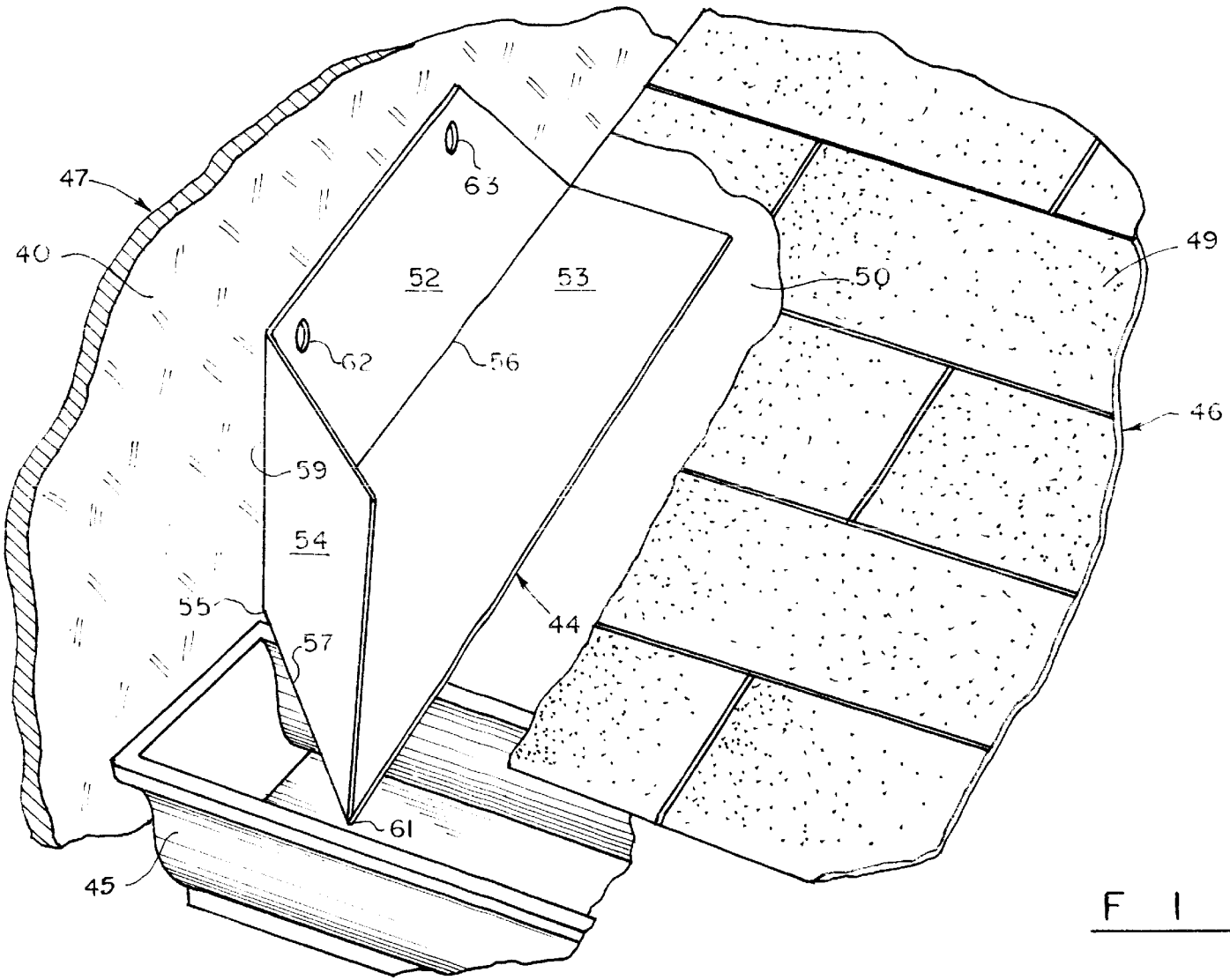
FIG. 2 is a perspective view of one example of a roof stop flashing positioned against a fragment of a building comprising a wall and a roof.

FIG. 2 shows another embodiment of one-piece flashing 44, called kick-out flashing, the purpose of which is to guide water to the gutter 45 while preventing it from infiltrating along an intersection between the roof 46 and a side wall 47 or farther on down the wall system. As in FIG. 1, no cladding is shown on the side wall adjacent the intersection with the roof, only the underlying sheathing 48. In addition, the shingles 49 and other roofing materials, including the customary roofing felt, have been removed adjacent that intersection to display the underlying roof sheathing 50.

The flashing 44 comprises a first panel 52 in surface-to-surface contact with the vertical side sheathing 48, a second panel 53, and a third panel 54. The third panel lies flat on the roof sheathing 50 and, accordingly, has the same slope. As in the case of the one-piece flashing 24 in FIG. 1, the panels 52–54 are joined together watertight at all of their common edges, or lines, or regions, of intersection, and the common corner 55. One of the lines of intersection 56 is shown between the panels 52 and 53, a second line of intersection 57 is shown between the panels 53 and 54, and a third line of intersection 59 is shown between the panels 52 and 54. As in all of the flashings described herein, all three of these lines of intersection radiate out from the common corner 55 to the perimeter of the flashing 44, specifically to intersections between each panel and the adjacent panels on each side.

In FIG. 2, the third panel 54 is not in surface-to-surface contact with any other surface of the building, and although it is flat in this embodiment, flatness is not mandatory. Its lower corner 61 at the end of the line of intersection 57 extends beyond the edge of the roof and terminates over the gutter. The third panel 54 is not perpendicular to either the vertical first panel 52 or the sloping second panel 53. In this embodiment, it makes an obtuse angle of about 110° with the first panel. The angle between the third panel 54 and the second panel 53 will be based on the slope of the roof 46.

There are two nail holes 62 and 63, each about 5" from the intersection of the sheathing with the roof, which would place these holes well above the lower edge of any wall cladding later to be applied to the wall sheathing 48. The front panel 54 of the one-piece kick-out flashing 44 is preferably about 13.5" high, and this panel sticks out about 4" from the side wall 47.

The width of the second panel 53 from the line of intersection 56 between that panel and the wall panel 52 is sufficient to carry any runoff beyond the lower corner 61 and is preferably at least about 4". It is advantageous to use bond breaker tape between the wall sheathing 48 and the wall panel 52 located over the gutter 45 in the kick-out flashing 44.

The one-piece flashing 44 can be made of the same materials and in the same way as the one-piece flashing 24 in FIG. 1. Since the panels 52–54 are all folded toward each other, they can be made of a single sheet of metal and do not require a second sheet, such as is necessary to form some part of the panel 27 in FIG. 1. The one-piece flashing 44 can be pressed out of sheet metal without any weld, and it can be formed of plastic in any of the ways suitable for that material. However, it is essential, as in all other flashings, that the common corner 55 be watertight, along with the lines of intersection radiating from it.

Figure 3:
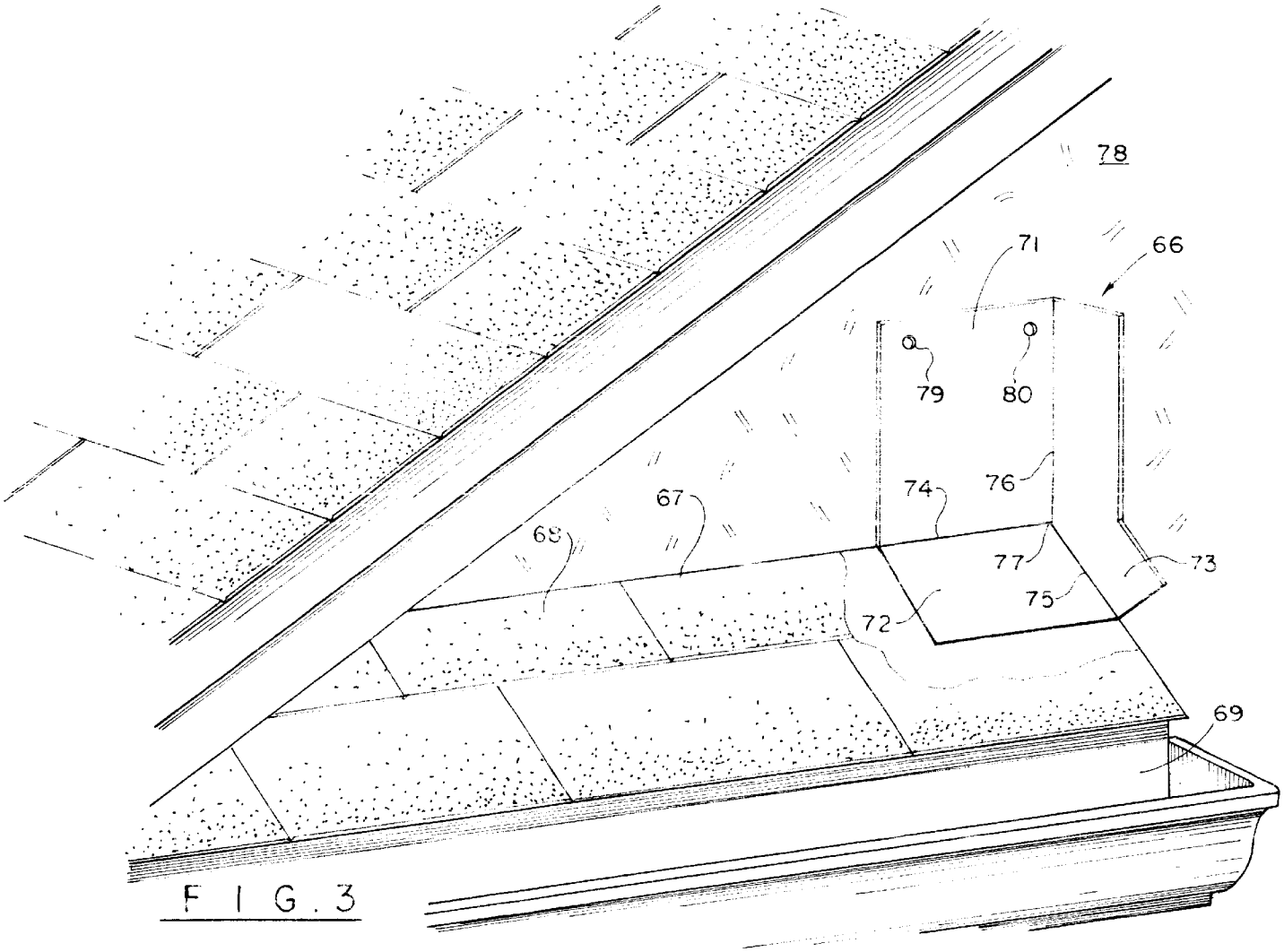
FIG. 3 is a perspective view of one example of a kick-out flashing positioned against a fragment of a building comprising a vertical wall and a sloping roof, with the flashing overhanging a gutter to direct water away from the building surfaces and into the gutter.

FIG. 3 shows a third embodiment of this invention. It is referred to as a roof stop flashing 66, which is located at the end of a gable return 67 and is designed to stop and to divert water from running into the face wall 68 at the point where the gable return terminates and the wall is continuous, above and below the soffit 69 and will prevent infiltration of water at any point along that path.

The one-piece roof stop flashing 66 has three panels 71–73. joined together at watertight lines of intersection 74–76 to make a watertight structure, including, particularly, their common corner 77. The reason for emphasizing the watertightness at the common corners in the embodiments used to illustrate this invention is that such corners have heretofore been a particularly difficult points to obtain a sufficient seal in prior, multi-piece flashing assemblies.

The panel 71 of the roof stop flashing 66 is held flat against the vertical wall sheathing 78 by fasteners through two holes 79 and 80, and the panel 72 lies flat against the gable return, the slope of which determines the angle between these two panels. The third panel 73 extends out from the wall sheathing 78 to prevent water from running to the right of that panel. The dimension of the panel is about 3" from the line of intersection 75 and about 3" from the line of intersection 76.

It should be pointed out that all three of the one-piece flashings 24, 44, and 66 would be made not only in the form shown but also in mirror images of those forms. The one-piece roof stop flashing can be made of the same materials and in any of the ways described heretofore in the descriptions of the one-piece corner flashing 24 in FIG. 1 and the one-piece flashing 44 in FIG. 2.

Figure 4:
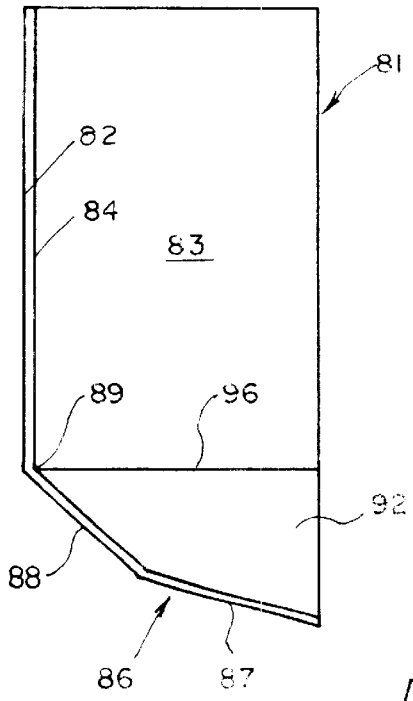
FIGS. 4–6 are orthographic views of an alternative form of one-piece kick-out flashing.
Figure 5:
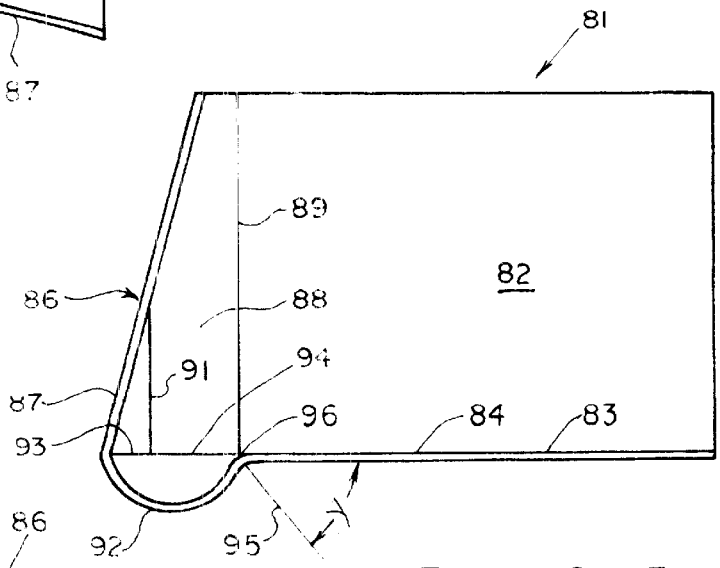
Figure 6:
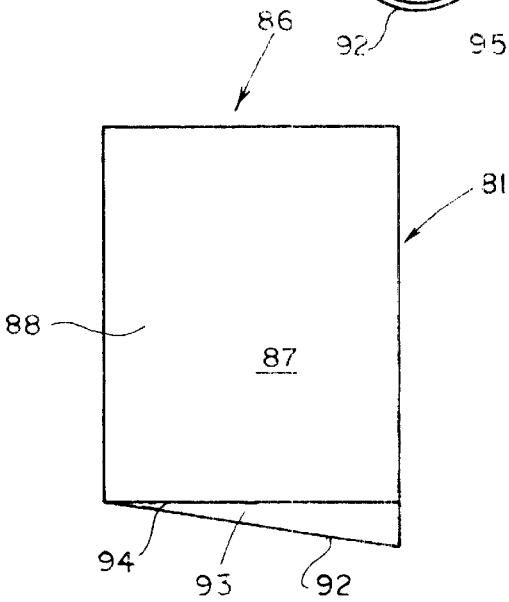

FIGS. 4–6 are orthographic views of an alternative form of one-piece kick-out flashing 81 having a first panel 82 that is to be placed in surface-to-surface contact with a vertical wall panel in a manner similar to the kick-out flashing 44 in FIG. 2.

The kick-out flashing 81 also has a second panel 83 that intersects the panel 82 perpendicularly at a region of intersection 84. Instead of a flat panel at the end of the panels 82 and 83, which would be the downhill ends of these panels, the kick-out flashing 81 has a panel 86 of more complex, non-flat configuration that eases water into the gutter and includes a main part 87 and a secondary part 88 that joins the main part of the panel 82 along a region of intersection 89. The main and secondary parts of the panel 86 are joined along a line of intersection 91. The bottom edges of the parts 87 and 88 are joined to the proximal edge of the panel 83 by a sloping channel 92, which is configured somewhat like a sector of a conical shell, that carries water down to a gutter in the manner shown in FIG. 2. One side of this channel has a line, or region, of intersection 93 with the part 87 and another line, or region, of intersection 94 with the part 88. The other side of the channel 92 is joined to the proximal edge of the panel 83 at a, or region; line of intersection 96, and the channel 92 comprises a region of intersection joining the panel 83 watertight to the panel 86.

As in the kick-out flashing 44 in FIG. 2, the panels 82, 83, and 86 and the channel 92 form a unitary, unbroken structure that is formed without any holes or seams requiring that they be joined together on the job or at any time after original formation. In particular, a common point at the junction 98 of the lines of intersection 89, 94, and 96 is thus formed watertight. There is another common point at the junction 98 of the lines of intersection 91, 93, and 94 that is also formed in the same way so that it is watertight. In this embodiment, the intersections between the panels 82, 83, and 86, particularly the more or less conically curved shell 92, tend to be curved regions and not sharp lines.

Figure 7:
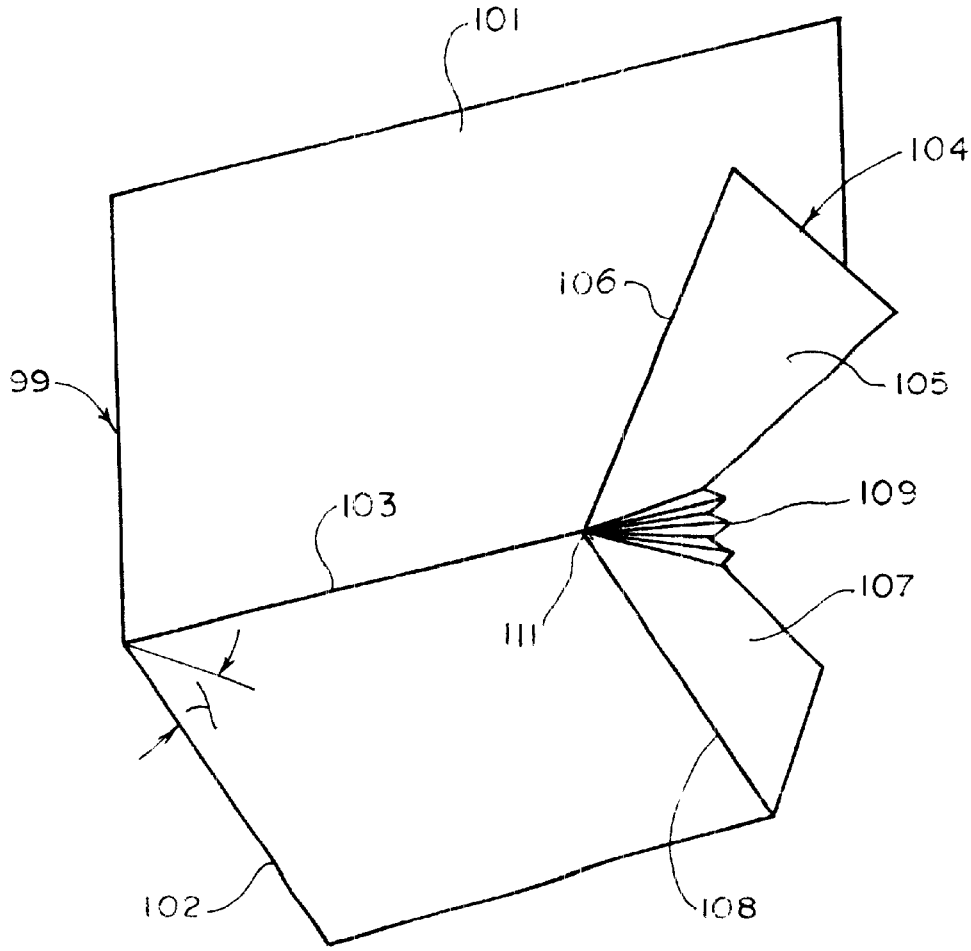
FIG. 7 shows a modified form of one-piece roof stop flashing incorporating means to permit the flashing to accommodate different roof slopes.

FIG. 7 is a modified form of one-piece roof stop flashing 99 similar to the roof stop flashing 66 in FIG. 3 except that the flashing 99 has a vertical panel 101 that is wider at the top than at the bottom. This panel is joined to a second panel 102 that slopes at an angle $\gamma$ equal to the slope of the roof and joins the panel 101 along a watertight line of intersection 103. One edge of panel 101 joins the upper part 105 of a third panel 104 along a watertight line of intersection 106, and in this embodiment, that edge of the panel 101 slopes at an angle of 120°. The panel 104 includes a second part 107 joined to the panel 102 along a line of intersection 108 and to the part 104 by a plurality of narrow, accorion-folded pleats 109 that allow the slope of the panel 102 to be varied according to the slope of the roof stop. All four of the lines of intersection 103, 106, 108, and 109, including, if necessary, the pleats 109, meet at a common point 111, and in accordance with a fundamental aspect of this invention, all of these lines, or regions, of intersection and the common point at which they meet are formed watertight. Although the dimensions are not critical, the height T of the panel 101 is 6" and the width U of the panel 102 and of the bottom edge of the panel 101 is also 6". In this embodiment, the panel 107 is vertical, but it can also be tilted out at the same angle as the panel 104 so that the panels 104 and 107 can be one L-shaped panel without the need of a line of intersection between its two parts. The reason for tilting at least the panel 104 outwardly is to help shield the part of the building wall below it from receiving any water due to a storm. In addition, an extension flange 115 may extend out, for example about 4", from the intersection of the panels 101 and 104 to help prevent water infiltration in that region. The top edge of the panel 101 and flange may conveniently be about 6" from the intersection 103, while it is suitable for the top edge of the panel 104 to be only about 4" from the intersection 103.

Figure 8:
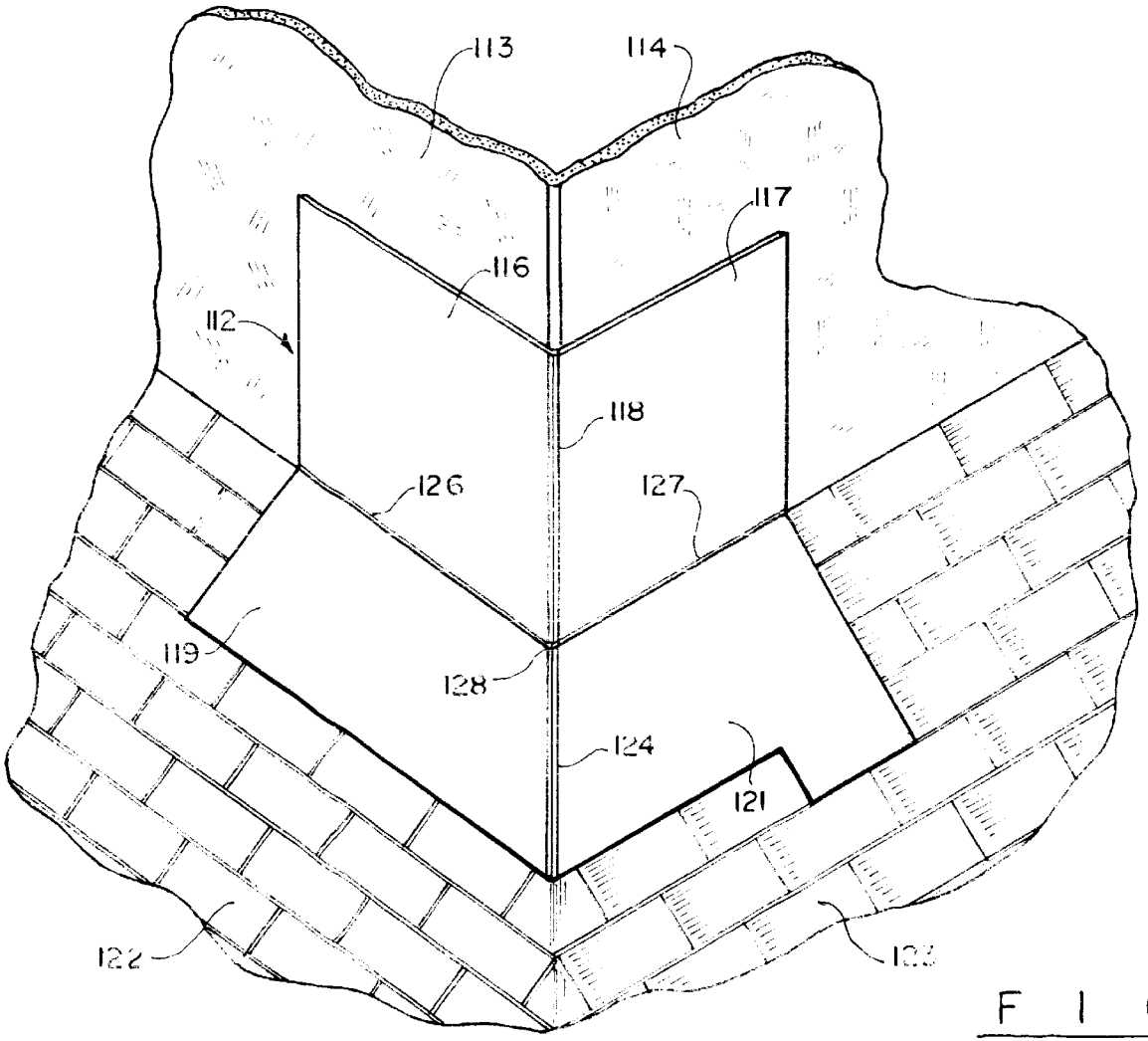
FIG. 8 shows a one-piece corner flashing mounted at the junction of two vertical, perpendicular wall panels.

FIG. 8 shows a one-piece corner flashing 112 mounted at the junction of two vertical, perpendicular wall panels 113 and 114. The flashing 112 comprises two vertical panels 116 and 117 held flat against the panels 113 and 114, respectively and joined together along a vertical line of intersection 118. Two panels 119 and 121 extend downwardly from the lower edges of the panels 116 and 117 and slope outwardly at the same angle as the slope of the two roof parts 122 and 123 and are joined together by a watertight line of intersection 124. The panel 119 is joined to the panel 116 along a watertight line of intersection 126, and the panel 121 is joined to the panel 117 along another watertight line of intersection 127. The lines of intersection 118, 124, 126, and 127 converge at an inherently watertight common point 128. In this embodiment, the flashing 112 is symmetrical about a plane defined by the lines of intersection 118 and 124.

Figure 9:
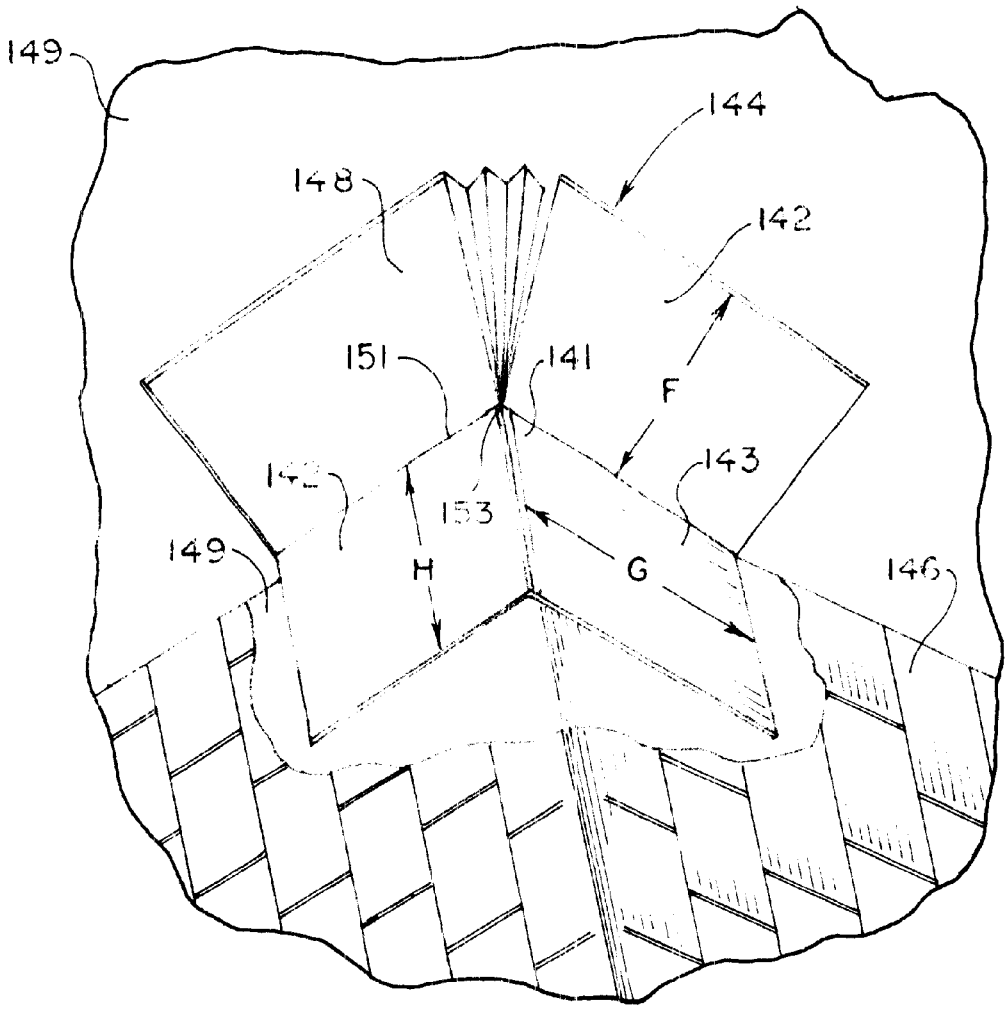
FIG. 9 shows a ridge saddle flashing to be installed where one end of a lower roof terminates at a vertical wall, the saddle flashing incorporating means to permit it to accommodate different roof slopes.

FIG. 9 shows a straight ridge saddle flashing 141. This is the only flashing illustrated in this description that would not need to be made in two mirror-image configurations. It comprises two panels 142 and 143 that saddle the ridge of a roof formed of two panels 144 and 146 of equal slope. These panels are joined together along a watertight region of intersection 147, which is basically a sector of a tubular shell to fit over shingles of the roof. A vertical panel 148, which is held against a vertical wall 149 of a building, joins the panel 142 along a line of intersection 151 and the panel 143 along a line of intersection 152. The latter lines of intersection join the line of intersection 147 at a common, watertight point 153. As in all of the other embodiments of this invention, the flashing 141 is formed as a one-piece structure that is watertight at all lines of intersection and at the point common to these lines of intersection. The vertical panel 148 can include pleats 154, as shown, to allow the flashing to be bent to change the angle between the panels 142 to allow for different roof pitches. These pleats may also extend along the region of intersection 147 to increase its flexibility. As in all cases of flashings having pleats, one surface of which lies against a wall, the pleats should not extend out from that surface by more than about an eighth of an inch.

Figure 10:
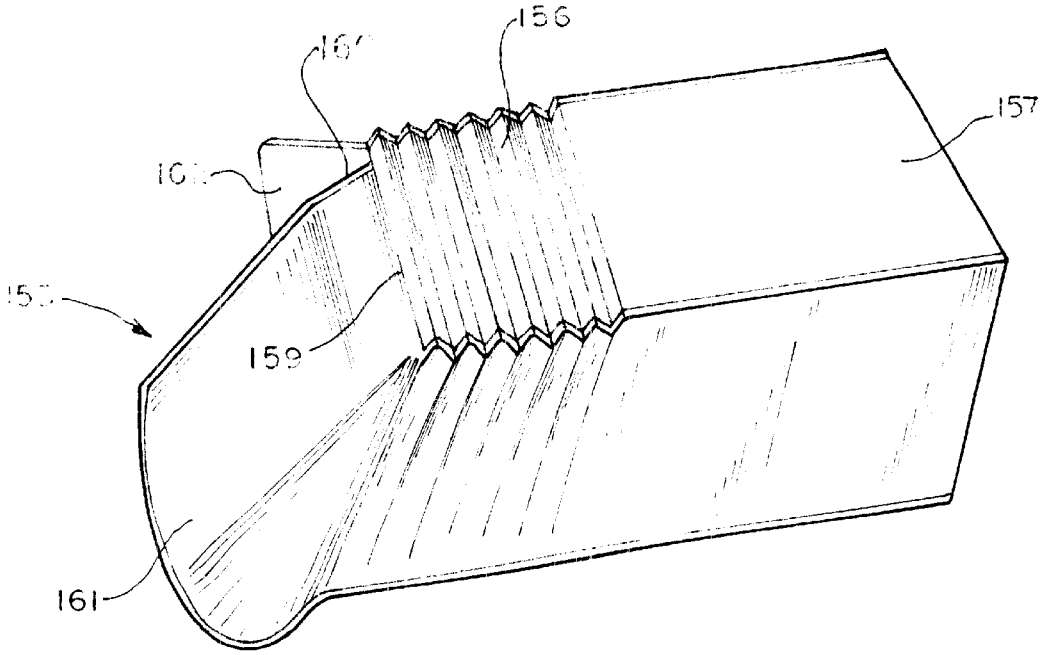
FIG. 10 shows a modified form of kick-out flashing with means to accommodate different roof slopes.

FIG. 10 shows a modified form of kick-out flashing 155 with pleats 156 in the panel 157 to accommodate different roof slopes. These pleats permit the flat part of the panels 157 and 158 to be tilted according to the slope of the roof of the building on which the flashing 155 is installed. The intersection 159 between the pleats 156 and the proximal edge of the front panel 161 should preferably be at an angle of about 110° as installed. This tends to prevent water from running under the front surface of the panel 161.

A further aide in preventing water from being driven in behind the intersection 159 and the wall of the building is a flange 162 that is an extension of the panel 157 and may extend out about 4" beyond the intersection. The top edge of this flange may be even with the top edge of the panel 157, which may be about 2" above the top edge of the proximal part of the front panel 160 that guides water away from the roof and into the gutter, and the bottom edge of this flange 162 may extend a short distance, for example, about an inch below the bottom edge of the intersection 159.

Figure 11:
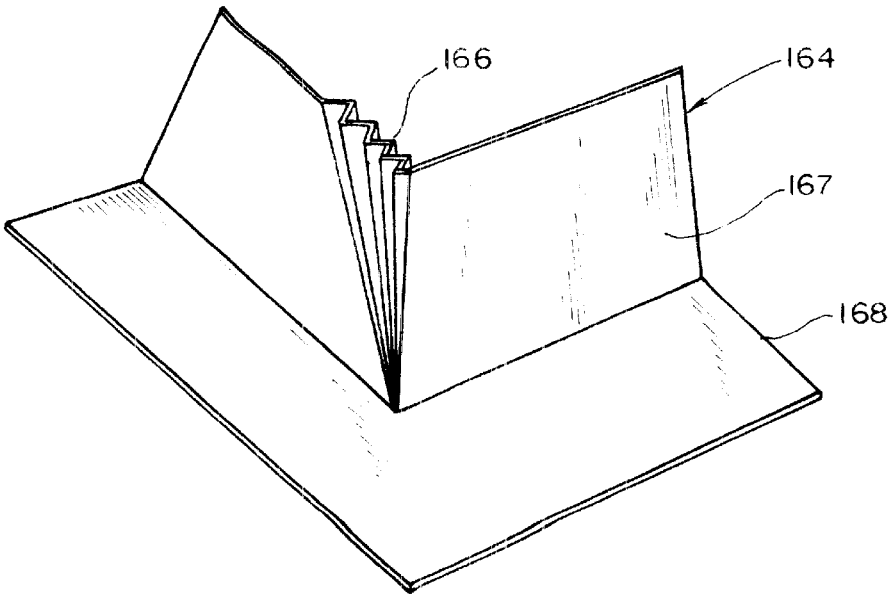
FIG. 11 shows a modified form of corner flashing including means to accommodate roofs with different slopes.

FIG. 11 shows a modified form of corner flashing 164 that includes pleats 166 to allow the front panel 167 to be tilted to fit against the front surface of a dormer or chimney while allowing the panel 168 to lie flat on the roof and thus accommodate roofs with different slopes.

While this invention has been described in specific terms for better understanding, it will be understood by those familiar with the roofing trade and trades that work closely with the roofing trade that modifications may be made in the configurations and dimensions of these flashings without departing from the following claims.

What is claimed is:

1. A one-piece flashing comprising first, second, and third panels of material impervious to water, each of the panels having first and second edges that radiate from a common location on the respective panel, each of said first and second edges of each of the panels extending alongside and being joined watertight to the proximal first or second edge of the panels on each side thereof, the common locations of all of the panels being substantially at a watertight corner, and the panels being angularly displaced from each other with the third panel being displaced from the first panel by an angle greater than 90° and from the second panel by less than 90°.

2. A one-piece flashing according to claim 1 in which:

(a) the first and second panels are perpendicular to each other; and (b) the third panel is at an angle greater than 90° with respect to the first panel and less than 90° with respect to the second panel.

3. A one-piece flashing according to claim 1 in which:

(a) the first and second panels are operationally substantially flat; and (b) the third panel is concave facing the first and second panels.

4. A one-piece flashing according to claim 3 comprising: a trough joining one edge of the concave third panel to one edge of the second panel, a main portion of the third panel being tilted away from the second panel by an angle less than 90°.

5. A one-piece flashing according to claim 4 in which the trough is tapered.

6. A one-piece flashing according to claim 3 in which the third panel comprises a cylindrically curved portion.

7. A one-piece flashing according to claim 1 comprising: a trough joining the second panel to the third panel to direct water away from the first and second panels.

8. A one-piece flashing according to claim 1 in which:

(a) the first and second panels are perpendicular to each other;

(b) the third panel is perpendicular to the first panel and at an angle greater than 90° with respect to the second panel;

(c) the first panel extends away from the second and third panels; and (d) the third panel extends away from the first and second panels and intersects the first and second panels at a common corner.

9. A one-piece flashing according to claim 8 in which the first panel comprises an accordion-pleated section to allow the angle between the second and third panels to be modified.

10. A one-piece flashing according to claim 1 in which: the second panel is at an angle greater than 90° with respect to the first panel, whereby the first panel can be attached vertically against a wall of a building and the second panel can be placed against a roof stop extending downwardly and outwardly from the wall.

11. A roof stop flashing according to claim 10 in which the first panel is widest at its edge remote from the second panel.

12. A roof stop flashing according to claim 11 in which the third panel comprises two angularly disposed portions.

13. A pre-formed flashing for preventing water infiltration at the intersection of a planar wall surface and a planar roof surface of a building, the roof surface intersecting the wall surface along a horizontal line of intersection and extending away from the plane of the wall surface at an obtuse angle, said flashing comprising:

(a) a substantially planar first water-impervious panel that includes a first common location;

(b) a substantially planar second water-impervious panel that has first and second edges that converge toward a second common location on the second panel;

(c) a first water-impervious region of intersection joining the first edge of the second panel to the first panel and with the common locations closely adjacent each other, the second panel extending away from the plane of the first panel in a certain direction and at an obtuse angle with respect to the first panel;

(d) a third water-impervious panel having first and second portions with first and second edges, respectively, that converge toward a third common location:

(e) a second water-impervious region of intersection joining the first edge of the third panel to the first panel, (f) a third water-impervious region of intersection joining the second edge of the third panel to the second edge of the second panel, a first portion of the third panel adjacent the second water-impervious region of intersection extending away from the first panel at a second angle with respect to the first panel and a second portion of the third panel adjacent the third water-impervious region of intersection extending away from the second panel at a third angle with respect to the second panel, whereby the first, second and third panels and the water-impervious regions joining them together define a common corner impervious to water, whereby the one-piece flashing is impervious to water.

14. A preformed flashing according to claim 13 in which:

(a) the first water-impervious region of intersection comprises a sector of a hollow cylinder joining the first panel to the second panel; and (c) the third panel is perpendicular to the first and second panels.

15. A preformed flashing according to claim 14 in which the third panel comprises accordion-pleated section to allow the angle between the first and second panels to be modified.

16. A self-supporting, one-piece, weather-resistant, multi-panel flashing impervious to water and comprising:

(a) a first panel comprising a first edge and a certain location on the first panel proximal to a point on the first edge;

(b) a second panel substantially perpendicular to the first panel and comprising first and second edges that converge toward a certain location on the second panel, the first edge of the second panel extending along the first edge of the first panel and being joined watertight to the first panel with the respective certain locations on the second and first panels being adjacent each other;

(c) a third panel comprising first and second edges converging toward a certain location on the third panel, the first edge of the third panel being adjacent to and joined watertight to the first panel, at least a portion of the third panel adjacent the first edge thereof extending away from the first panel at an included angle greater than 90°, the second edge of the third panel extending generally along a substantial portion of the second edge of the second panel, a substantial portion of the third panel being at an included angle less than 90° to the second panel, and the respective common locations on the first, second, and third panels being proximal to each other and joined together to form a watertight common corner.

17. A self-supporting, one-piece flashing according to claim 16 in which the first and second edges of one of the panels are substantially perpendicular to each other and the first and second edges of another of the panels are not perpendicular to each other.

18. A self-supporting, one-piece flashing according to claim 16 in which each of the panels is not substantially thicker than ⅛".

19. A self-supporting, one-piece flashing according to claim 18 formed of plastic.

20. A self-supporting, one-piece flashing according to claim 19 molded of plastic as a unitary structure.

21. A self-supporting, one-piece flashing according to claim 16 further comprising creases in at least one of the panels emanating from a region proximal to the watertight common corner to allow the angle between two of the panels to be adjusted.

* * * * *